US009982566B2

(12) United States Patent
Gieg et al.

(10) Patent No.: US 9,982,566 B2
(45) Date of Patent: May 29, 2018

(54) TURBOMACHINE, SEALING SEGMENT, AND GUIDE VANE SEGMENT

(71) Applicant: MTU Aero Engines AG, Munich (DE)

(72) Inventors: Walter Gieg, Eichenau (DE); Petra Kufner, Poing (DE); Rudolf Stanka, Rattenkirchen (DE)

(73) Assignee: MTU AERO ENGINES AG, Munich (DE)

( * ) Notice: Subject to any disclaimer, the term of this patent is extended or adjusted under 35 U.S.C. 154(b) by 950 days.

(21) Appl. No.: 14/329,570

(22) Filed: Jul. 11, 2014

(65) Prior Publication Data

US 2015/0016969 A1 Jan. 15, 2015

(30) Foreign Application Priority Data

Jul. 15, 2013 (EP) ..... 13176503

(51) Int. Cl.

| | |
|---|---|
| ***F01D 25/18*** | (2006.01) |
| ***F01D 11/12*** | (2006.01) |
| ***F01D 9/02*** | (2006.01) |
| ***F01D 25/24*** | (2006.01) |

(52) U.S. Cl.

CPC ..... *F01D 25/183* (2013.01); *F01D 9/02* (2013.01); *F01D 11/12* (2013.01); *F01D 25/246* (2013.01); *F05D 2230/64* (2013.01); *F05D 2240/11* (2013.01)

(58) Field of Classification Search

CPC ..... F01D 25/183; F01D 25/246; F01D 11/08; F01D 11/12; F01D 9/041; F01D 9/042; F05D 2240/11; F16J 15/44; F16J 15/441; F16J 15/442; F16J 15/444; F16J 15/447

See application file for complete search history.

(56) References Cited

U.S. PATENT DOCUMENTS

| | | | | |
|---|---|---|---|---|
| 3,365,173 A * | 1/1968 | Lynch | F01D 9/042 415/209.2 |
| 5,772,400 A * | 6/1998 | Pellow | F01D 11/24 415/173.1 |
| 7,997,856 B2 * | 8/2011 | Khanin | F01D 11/08 415/116 |
| 8,152,455 B2 * | 4/2012 | Wunderlich | F01D 11/08 415/173.1 |
| 2004/0101400 A1 * | 5/2004 | Maguire | F01D 9/04 415/116 |

(Continued)

*Primary Examiner* — Woody Lee, Jr.
*Assistant Examiner* — Elton Wong
(74) *Attorney, Agent, or Firm* — Barlow, Josephs & Holmes, Ltd.

(57) ABSTRACT

A turbomachine includes a sealing segment ring that is provided between a front guide vane row and a back guide vane row for sealing a radial gap between a casing section and a rotor blade row rotating between the guide vane rows, wherein the sealing segment ring has a plurality of identical sealing segments and at least one of the guide vane rows has a plurality of identical guide vane segments, wherein the sealing segments each have a plurality of engagement sites lying adjacent to one another in the peripheral direction for interaction with securing elements of this guide vane row, wherein the engagement sites and securing elements are distributed uniformly over the periphery and the engagement sites are a multiple of the securing elements, a sealing element, and a guide vane segment.

5 Claims, 2 Drawing Sheets

(56) References Cited

U.S. PATENT DOCUMENTS

| | | | | |
|---|---|---|---|---|
| 2004/0151582 | A1 | 8/2004 | Faulkner | |
| 2005/0002779 | A1 | 1/2005 | Tanaka | |
| 2005/0004810 | A1* | 1/2005 | Tanaka | F01D 9/04 415/173.1 |
| 2007/0122270 | A1* | 5/2007 | Brueckner | F01D 9/042 415/191 |
| 2010/0247298 | A1 | 9/2010 | Nakamura et al. | |
| 2011/0243725 | A1 | 10/2011 | Jones et al. | |

* cited by examiner

TURBOMACHINE, SEALING SEGMENT, AND GUIDE VANE SEGMENT

BACKGROUND OF THE INVENTION

The invention relates to a turbomachine, a sealing segment, and a guide vane segment for such a turbomachine.

A sealing segment ring is commonly provided for sealing a radial gap between blade tips of a row of rotor blades and a casing section surrounding the row of rotor blades of a turbomachine, such as a gas turbine, said sealing segment ring extending on the casing side between a front row of rotor blades and a back row of rotor blades. In a known sealing arrangement, the sealing segment ring consists of a plurality of identical sealing segments, each of which has a plurality of slots for form-fitting interaction with an identical number of projections of the front row of guide vanes for peripheral securing at the front edge portion of the sealing segments. The guide vane rows are composed of a plurality of identical guide vane segments, with the number of sealing segments being equal to the number of front guide vane segments or the front guide vane segments being an integral multiple of the sealing segments in this kind of peripheral securing. Thus, there are commonly 15, 5, or 3 sealing segments for 15 guide vane segments. Shown in US 2005002779 A1 is such a peripheral securing arrangement in the region of a back edge portion of the sealing segments and a back row of guide vanes.

BRIEF SUMMARY OF THE INVENTION

An object of the invention is to create a turbomachine having a peripheral securing of a sealing segment ring with an alternative number of sealing segments for sealing a radial gap between a casing section and a row of rotor blades. Furthermore, it is an object of the invention to create a sealing segment for such a sealing segment ring as well as a guide vane segment for such a row of guide vanes.

This object is achieved by a turbomachine, by a sealing segment, and by a guide vane segment of the present invention.

A turbomachine according to the invention has a sealing segment ring between a front row of guide vanes and a back row of guide vanes for sealing a radial gap between a casing section and a row of rotor blades rotating between the guide vane rows. The sealing segment ring has a plurality of identical sealing segments and at least one of the guide vane rows has a plurality of identical guide vane segments. According to the invention, the sealing segments each have a plurality of engagement sites lying adjacent on one another in the peripheral direction for interaction with the securing elements of this guide vane row, with the engagement sites and securing elements being distributed uniformly over the periphery and the engagement sites being a multiple of the securing elements.

The invention makes possible the peripheral securing and the formation of a sealing segment ring, the number of sealing segments of which is not an integral subset of a number of guide vane segments. For 15 guide vane segments, it is possible owing to the invention to realize 10 sealing segments, for example. The number of sealing segments can thus be determined optimally in terms of structural mechanics, fabrication engineering, and/or cost-related aspects. Owing to the fact that the engagement sites are a multiple of the securing elements, not all engagement sites are located so as to engage with the securing elements in the mounted state and can thus serve for compensation of different thermal expansion behaviors of the sealing elements and of the guide vane segments.

Preferably, the guide vane segments of the relevant row of guide vanes have only one securing element. In this way, each sealing segment is joined to a guide vane segment of this guide vane row only by means of one engagement between an engagement site and a securing element. As a result of only one form-fitting connection per sealing segment and guide vane segment, any seizing of the components during mounting is prevented. Also, owing to the single connection per sealing segment and guide vane segment, different thermal expansions of the components can better be taken into consideration.

In order to be able to mount the guide vane segments of this guide vane row and the sealing segments at any arbitrary peripheral position, it is advantageous when each sealing segment has the same plurality of engagement sites and these engagement sites as well as the securing elements are arranged at identical positions on the sealing segments or the guide vane segments. At the same time, as a result of the respectively identical arrangement of engagement sites and securing elements, the fabrication of the sealing segments and that of the guide vane segments is simplified.

In an exemplary embodiment, the securing element of the respective guide vane segment and the engagement sites of the respective sealing segment are arranged symmetrically to the respective longitudinal axis of the segment.

In a preferred exemplary embodiment, 1.5 times as many guide vane segments of the guide vane row as sealing segments, and three times as many engagement sites per sealing segment as securing elements per guide vane segment are provided. In this way, every second engagement site is engaged with a securing element or the engagement sites are alternately each occupied by one securing element. As viewed over the periphery, the engagement sites alternately engage with a securing element. The double engagement in this case is to be taken into consideration in the design of tolerances and thermal expansions.

A sealing segment according to the invention for a turbomachine according to the invention has a plurality of engagement sites that are uniformly spaced apart in the peripheral direction for interaction with a corresponding securing element.

A guide vane segment according to the invention for a turbomachine according to the invention has only one securing element for interaction with a corresponding engagement site of a sealing segment.

Other advantageous exemplary embodiments of the invention are the subject of the present invention.

BRIEF DESCRIPTION OF THE DRAWINGS

In the following, a preferred exemplary embodiment of the invention will be discussed in detail on the basis of schematic illustrations. Shown are.

DETAILED DESCRIPTION OF THE INVENTION

Figure 1:
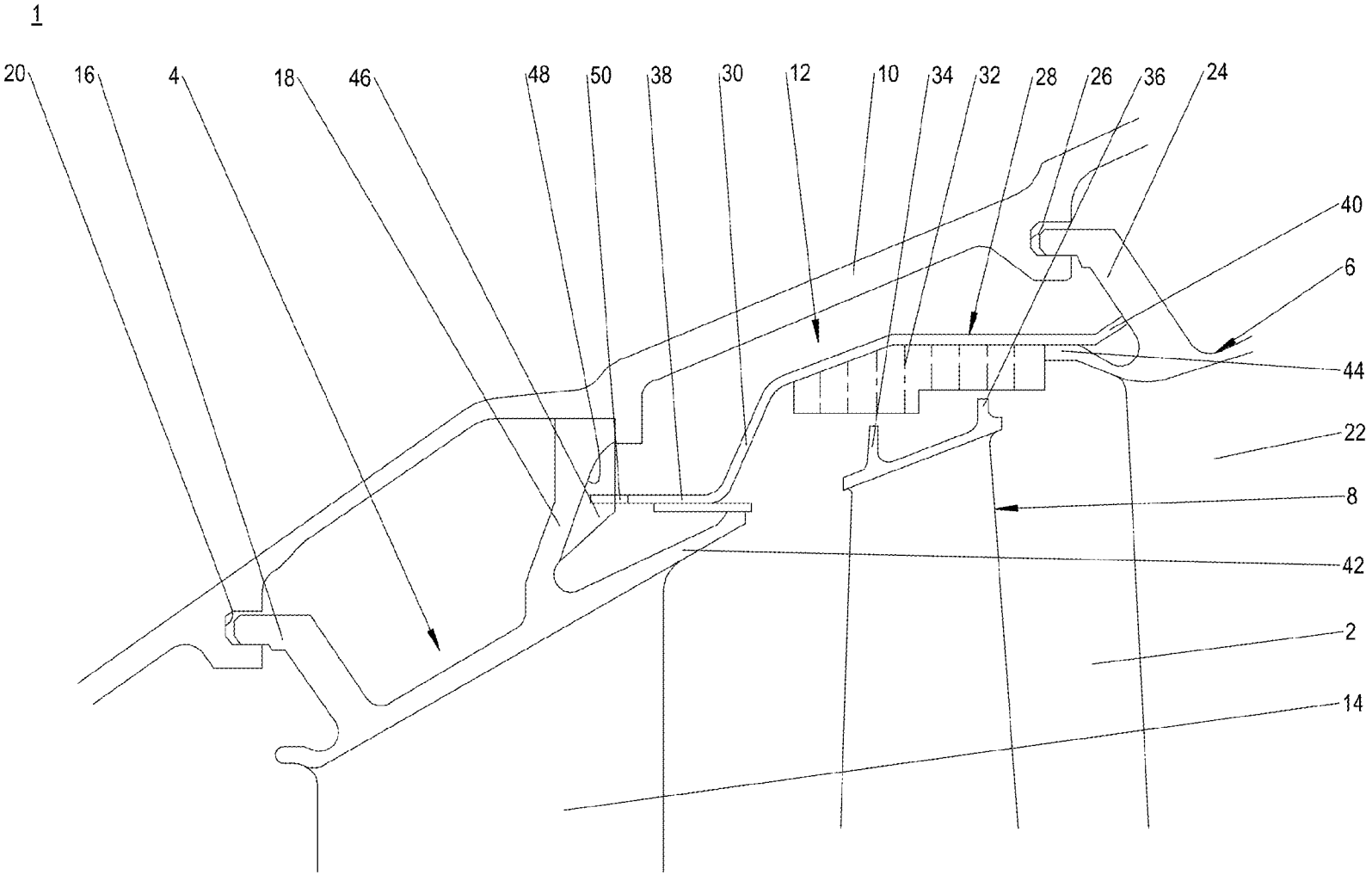
FIG. 1 is a longitudinal section through a radially outer region of a turbomachine.

As shown in FIG. 1, a turbomachine 1 according to the invention has a front stator-side guide vane row 4 and a back stator-side guide vane row 6, as viewed in the direction of a hot gas flowing through a hot gas duct 2, between which a rotor-side rotor blade row 8 rotates around a rotor axis that is not shown. The rotor blade row 8 is enclosed by a casing section 10 of the turbomachine 1, with a sealing segment ring 12 being arranged between the guide vane rows 4, 6 for sealing a radial gap between the rotor blade row 8 and the casing section 10. The turbomachine is, in particular, a gas turbine and preferably an aircraft engine. The vane or blade rows 4, 6, 8 as well as the sealing segment ring 12 are preferably located in the low-pressure turbine of the turbomachine 1.

The front guide vane row 4 has a plurality of identical guide vane segments 14, each of which has a plurality of vanes and by means of which a front holding portion 16 and a back holding portion 18 engage in a form-fitting manner in casing grooves 20 and the like of the turbomachine 1. The back guide vane row 6 likewise has a plurality of identical guide vane segments 22, which correspondingly interact in a form-fitting manner via front holding portions 24 and back holding portions, which are not shown, with casing grooves 26 and the like of the turbomachine 1.

The sealing segment ring 12 has a plurality of identical sealing segments 28, each of which has a multi-angle base body 30, at whose inner surface, facing the hot gas duct 2, seal honeycombs 32 are arranged for the entry of opposite-lying seal splines 34, 36 of the rotor blade row 8. The sealing segment ring 12 and the seal splines 34, 36 constitute the so-called outer air seal (OAS). Each base body 30 is situated with its front edge portion 38 and its back edge portion 40 in axial overlap with platform overhangs 42, 44 of the guide vane segments 14, 22. The platform overhangs 42, 44 are guided over the respective edge portion 38, 40 and the edge portions 38, 40 are guided under the respective platform overhang 42, 44. The edge portions 38, 40 are thus arranged radially outside with respect to the platform overhangs 42, 44.

The front guide vane segments 14 each have a securing element for securing the sealing segment ring 12 in the peripheral direction between the guide vane rows 4, 6, said securing element being a securing spline 46 in the exemplary embodiment shown here, with which the sealing segments 28 interact in a form-fitting manner. The securing splines 46 each extend radially outward at a distance to the platform along a back side 48 of the back holding portion 18 of the respective guide vane segment 14. For form-fitting interaction with the securing splines 46, the sealing segments 28 each have a plurality of engagement sites, which are designed as slots 50 in the exemplary embodiment shown here. These slots 50 are open on the upstream side and each of them passes through the front edge portion 38 of the base body 30. A detailed explanation of the peripheral securing is presented in FIG. 2 on the basis of four guide vane segments 14*a*, 14*b*, 14*c*, 14*d* and three sealing segments 28*a*, 28*b*, 28*c* in the region of the back holding portion 18 and the front edge portion 38.

Each guide vane segment 14*a*, 14*b*, 14*c*, 14*d* has a single securing spline 46*a*, 46*b*, 46*c*, 46*d*, which, in the exemplary embodiment shown here, is positioned centered in the peripheral direction on the back side 48 of the back holding portion 18. The position of the securing spline 46*a*, 46*b* is clearly not restricted to a central position. The securing splines 46*a*, 46*b*, 46*c*, 46*d* lie at identical positions of the guide vane segments 14*a*, 14*b*, 14*c*, 14*d*. The peripheral distance to the two lateral edges 52, 54 of the holding portion 18 is thus identical. In each case, the single securing spline 46*a*, 46*b*, 46*c*, 46*d* per guide vane segment 14*a*, 14*b*, 14*c*, 14*d* lies on a longitudinal axis of the respective guide vane segment 14*a*, 14*b*, 14*c*, 14*d*, extending roughly in the flow direction of the hot gas, and is thus oriented symmetrically with respect to the longitudinal axis in the peripheral direction. As viewed over the periphery of the guide vane row 4, the securing splines 46*a*, 46*b*, 46*c*, 46*d* are spaced uniformly apart from one another.

Figure 2:
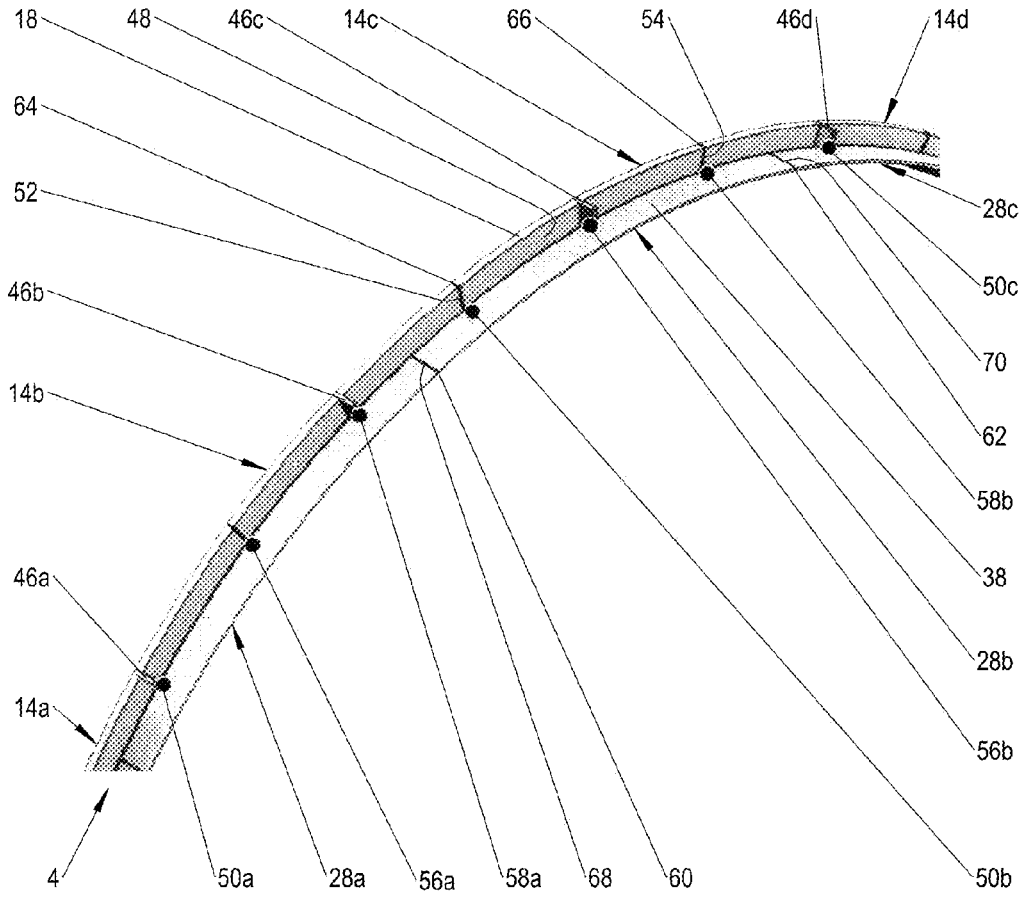
FIG. 2 is a form-fitting interaction of guide vane segments and sealing segments based on FIG. 1.

The sealing segments 28*a*, 28*b*, 28*c* each have three slots 50*a*, 56*a*, 58*a* or 50*b*, 56*b*, 58*b* or 50*c*, which are illustrated in FIG. 2 as dots so as to distinguish them from joints 60, 62, 64, 66 between adjacent sealing segments 28*a*, 28*b*, 28*c* and adjacent guide vane segments 14*a*, 14*b*, 14*c*, 14*d*. Based on the excerpt in FIG. 2, only the slot 50*c* of the three slots of the sealing segment 28*c* is visible. The slots 50*a*, 56*a*, 58*a* or 50*b*, 56*b*, 58*b* or 50*c* lie at identical positions on the sealing segments 28*a*, 28*b*, 28*c*. The number of slots 50*a*, 56*a*, 58*a* or 50*b*, 56*b*, 58*b* or 50*c* per sealing segment 28*a*, 28*b*, 28*c* (in this case, three slots 50, 56, 58 per sealing segment 28) is thus an integral multiple of the number of securing splines 46*a*, 46*b*, 46*c*, 46*d* per guide vane segment 14*a*, 14*b*, 14*c*, 14*d* (in this case, one securing spline 46 per guide vane segment 14).

The slots 50*a*, 56*a*, 58*a* or 50*b*, 56*b*, 58*b*, or 50*c* lie symmetrically in the peripheral direction with respect to the longitudinal axis of the sealing segments 28*a*, 28*b*, 28*c* extending roughly in the flow direction of the hot gas. One slot 56*a*, 56*b* lies directly on the longitudinal axis and is situated at an identical peripheral distance to the lateral edges 68, 70 of the respective sealing segment 28*a*, 28*b*, 28*c*. The two other slots 50*a*, 58*a* or 50*b*, 58*b* or 50*c* are situated on the two sides of the respective middle slot 56*a*, 56*b*. These lateral slots 50*a*, 58*a* or 50*b*, 58*b* or 50*c* are situated at an identical peripheral distance to the middle slots 56*a*, 56*b* and thus at an identical peripheral distance to the respectively near-lying lateral edge 68, 70. Obviously, the lateral slots 50*a*, 58*a* or 50*b*, 58*b* or 50*c* also lie at an identical peripheral distance to the respectively distanced lateral edge 70, 68. As viewed over the periphery of the sealing segment ring 12, the slots 50*a*, 56*a*, 58*a* or 50*b*, 56*b*, 58*b* or 50*c* are spaced uniformly apart from one another. The peripheral distance of the lateral slots 50*a*, 58*a* or 50*b*, 58*b* or 50*c* to the middle slot 56*a*, 56*b* is twice as great in the exemplary embodiment shown here as the peripheral distance to the respective near-lying lateral edge 68, 70.

The sealing segments 28*a*, 28*b*, 28*c* have a greater extension in the peripheral direction than do the guide vane segments 14*a*, 14*b*, 14*c*, 14*d*, so that the joints 60, 62 between the sealing segments 28*a*, 28*b*, 28*c* are arranged offset in the peripheral direction with respect to the joints 64, 66 of the guide vane segments 14*a*, 14*b*, 14*c*, 14*d*. In the exemplary embodiment shown, a sealing segment 28*a*, 28*b*, 28*c* has 1.5 times the peripheral extension than does a guide vane segment 14*a*, 14*b*, 14*c*, 14*d*. In this way, for example, 15 guide vane segments 14*a*, 14*b*, 14*c*, 14*d* are required for the formation of the guide vane row 4, but only 10 sealing segments 28*a*, 28*b*, 28*c* are required for the formation of the sealing segment ring 12. Or, in the exemplary embodiment shown here, there are 1.5 times as many guide vane segments 14*a*, 14*b*, 14*c*, 14*d* as sealing segments 28*a*, 28*b*, 28*c*.

In the exemplary embodiment shown, every second slot 50*a*, 58*a*, 56*b*, 50*c* of the sealing segment ring 12 is engaged with a securing spline 46*a*, 46*b*, 46*c*, 46*d* in each case. In other words, every second slot 56*a*, 50*b*, 58*b* is free. In the exemplary embodiment shown here, the securing spline 46*a* engages in the slot 50*a*, the securing spline 46*b* engages in the slot 58*a*, the securing spline 46*c* engages in the slot 56*b*, and the securing spline 46*d* engages in the slot 50*c*. The slots 56*a*, 50*b*, and 58*b* are not occupied. As viewed in the peripheral direction, the securing splines 46*a*, 46*b*, 46*c*, 46*d* virtually constantly "migrate" one slot 50*a*, 56*a*, 58*a* or 50*b*, 56*b*, 58*b* or 50*c* further. Because each guide vane segment 14*a*, 14*b*, 14*c*, 14*d* has available only one securing spline 46*a*, 46*b*, 46*c*, 46*d*, each guide vane segment 14*a*, 14*b*, 14*c*, 14*d* forms only one form-fitting connection with one sealing segment 28*a*, 28*b*, 28*c* or only one peripheral securing for a sealing segment 28*a*, 28*b*, 28*c*. On account of the "migrating engagement" in the peripheral direction, however, some of the sealing segments 28*a* are situated simultaneously with a plurality of guide vane segments 14*a*, 14*b* in form-fitting contact. Thus, in this case, the securing splines 46*a*, 46*b* of the guide vane segments 14*a*, 14*b* engage in a form-fitting manner in the slots 50*a*, 58*a* of the sealing segment 28*a*.

Disclosed are a turbomachine with a sealing segment ring between a front guide vane row and a back guide vane row for sealing a radial gap between a casing section and a rotor blade row rotating between the guide vane rows, wherein the sealing segment ring has a plurality of identical sealing segments and at least one of the guide vane rows has a plurality of identical guide vane segments, wherein the sealing segments each have a plurality of engagement sites lying adjacent to one another in the peripheral direction for interaction with securing elements of this guide vane row, wherein the engagement sites and securing elements are distributed uniformly over the periphery, and the engagement sites are a multiple of the securing elements, a sealing element, and a guide vane segment.

The invention claimed is:

1. A turbomachine with a sealing segment ring between a front guide vane row and a back guide vane row for sealing a radial gap between a casing section and a rotor blade row rotating between the guide vane rows, with the sealing segment ring having a plurality of identical sealing segments, and at least one of the guide vane rows having a plurality of identical guide vane segments, wherein the sealing segments each have a plurality of engagement sites comprising slots lying adjacent to one another in the peripheral direction on a front edge portion of the sealing segment for interaction with securing elements on the guide vane row, with the engagement sites and securing elements being distributed uniformly over the periphery and the engagement sites being a multiple of the securing elements, wherein each guide vane segment of the guide vane row has only one securing element.

2. The turbomachine according to claim 1, wherein each sealing segment has an identical plurality of engagement sites and the engagement sites as well as the securing elements are arranged at identical positions on the sealing segments or the guide vane segments of the guide vane row.

3. The turbomachine according to claim 1, wherein the securing element of the respective guide vane segment and the engagement sites of the respective sealing segment are arranged symmetrically relative to the respective longitudinal axis segment.

4. The turbomachine according to claim 1, wherein 1.5 times as many guide vane segments of the guide vane row as sealing segments and three times as many engagement sites per sealing segment as securing elements per guide vane segment are provided.

5. A turbomachine with a sealing segment ring between a front guide vane row and a back guide vane row for sealing a radial gap between a casing section and a rotor blade row rotating between the guide vane rows, with the sealing segment ring having a plurality of identical sealing segments, and at least one of the guide vane rows having a plurality of identical guide vane segments, wherein the sealing segments each have a plurality of engagement sites lying adjacent to one another in the peripheral direction for interaction with securing elements of the guide vane row, with the engagement sites and securing elements being distributed uniformly over the periphery and the engagement sites being a multiple of the securing elements, and wherein 1.5 times as many guide vane segments of the guide vane row as sealing segments and three times as many engagement sites per sealing segment as securing elements per guide vane segment are provided.

* * * * *